US007520270B2

(12) United States Patent
Uhara

(10) Patent No.: US 7,520,270 B2
(45) Date of Patent: Apr. 21, 2009

(54) PUMP MODULE FOR FUEL TANK

(75) Inventor: Shoji Uhara, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 65 days.

(21) Appl. No.: 11/285,110

(22) Filed: Nov. 23, 2005

(65) Prior Publication Data

US 2006/0107930 A1 May 25, 2006

(30) Foreign Application Priority Data

Nov. 24, 2004 (JP) ..... 2004-339632

(51) Int. Cl.
*F02M 37/10* (2006.01)
*F04B 17/00* (2006.01)

(52) U.S. Cl. ..... 123/509; 417/423.3

(58) Field of Classification Search ..... 123/509, 123/510, 514; 417/279, 313, 203, 462, 363, 417/364; 137/590, 565
See application file for complete search history.

(56) References Cited

U.S. PATENT DOCUMENTS

| | | | | |
|---|---|---|---|---|
| 4,747,388 | A | 5/1988 | Tuckey | |
| 5,762,049 | A * | 6/1998 | Jones et al. | 123/514 |
| 6,073,614 | A * | 6/2000 | Kleppner | 123/509 |
| 6,149,399 | A * | 11/2000 | Bowser et al. | 417/279 |
| 6,192,869 | B1 * | 2/2001 | Hahner et al. | 123/509 |
| 6,213,100 | B1 * | 4/2001 | Johansen | 123/509 |
| 6,439,205 | B2 | 8/2002 | Ushigome | |
| 6,598,593 | B1 * | 7/2003 | Kanamaru et al. | 123/509 |
| 6,729,308 | B1 * | 5/2004 | Kanamaru | 123/510 |
| 7,168,416 | B2 * | 1/2007 | Powell et al. | 123/509 |
| 2003/0213477 | A1 * | 11/2003 | Ramamurthy et al. | 123/509 |
| 2004/0000516 | A1 * | 1/2004 | Okabe et al. | 210/416.4 |
| 2004/0173187 | A1 * | 9/2004 | Kanamaru et al. | 123/509 |

FOREIGN PATENT DOCUMENTS

| | | | |
|---|---|---|---|
| CN | 1379844 | A | 11/2002 |
| EP | 1 486 662 | A1 | 12/2004 |
| GB | 2 172 864 | A | 10/1986 |
| JP | 02-030971 | | 2/1990 |
| JP | 2000-249011 | | 9/2000 |
| JP | 2002-295327 | | 10/2002 |
| JP | 2003-013817 | | 1/2003 |
| WO | WO 02/16752 | A1 | 2/2002 |

* cited by examiner

*Primary Examiner*—Stephen K Cronin
*Assistant Examiner*—Arnold Castro
(74) *Attorney, Agent, or Firm*—Arent Fox LLP

(57) ABSTRACT

A pump module to be disposed within a fuel tank is provided. The pump module includes a chamber, a fuel pump disposed within the chamber and a lid for member telescopically movably supporting the chamber via a telescopic means. An outside diameter of at least an upper end portion of the chamber is set to be smaller than an inside diameter of an inner tubular portion provided at the lid member, so that the upper end portion of the chamber can enter the inner tubular portion.

3 Claims, 5 Drawing Sheets

PUMP MODULE FOR FUEL TANK

FIELD OF THE INVENTION

The present invention relates to a pump module for a fuel tank and, more particularly, to a pump module for a fuel tank having a chamber with a fuel pump disposed therein, and a lid member designed to support the chamber telescopically movably relative thereto and mounted to a tank body.

BACKGROUND OF THE INVENTION

A fuel tank for use in a vehicle with a pump module provided inside to supply fuel to an engine with the pump module is disclosed in Japanese Patent Laid-Open Publication No. 2002-295327, for example. This fuel tank will be described with reference to FIG. 5.

As shown in FIG. 5, a pump module 100 for a fuel tank has a fuel pump 101 provided inside a chamber 102. The chamber 102 is supported on a lid member 105 via a sliding member 103 in a vertically movable manner. The lid member 105 closes an opening (hereinafter referred to as a tank opening) 104 in a tank body 106 with the chamber 102 disposed within the tank body 106. The chamber 102 within the tank body 106 is pressed onto the bottom of the tank body 106 by a spring member 108 of the sliding means 103.

With this pump module 100, the fuel pump 101 is driven to draw in fuel within the chamber 102 through a filter 110 to supply the indrawn fuel to an engine (not shown) through a supply pipe 112.

The tank body 106 generally changes in height due to changes in internal pressure, thermal expansion or the like. In order to constantly and adequately pump up fuel against the change, the pump module 100 has the sliding means 103 to move the chamber 102 up and down in response to changes in height of the tank body 106, thereby to constantly keep the chamber 102 at the bottom of the tank body 106.

The sliding means 103 includes a supporting rod 114 for supporting the chamber 102 vertically movably relative to the lid member 105. An upper end portion 114*a* of the supporting rod 114 is retained at the lid member 105. A compression spring 108 is provided on the supporting rod 114. A lower end portion 114*b* of the supporting rod 114 is slidably supported in a guide hole 116 in the chamber 102.

In the tank body 106 of a high height, the sliding means 103 presses the chamber 102 down with the compression spring 108 so as to keep the bottom 102*a* of the chamber 102 abutting the bottom of the tank body 106. On the other hand, in the tank body 106 of a low height, the chamber 102 is pressed up by the bottom of the tank body 106 against the compression spring 108. That is, the sliding means 103 is a position-adjusting means for the chamber 102 when the tank body 106 changes in height due to a change in internal pressure and thermal expansion.

In particular, the tank body 106 molded from resin has a relatively large amount of change in height due to a change in internal pressure, thermal expansion or the like.

In addition, automobiles have been diversified in form in recent years, and there is the need to prepare thin fuel tanks of low heights, for example, to meet the diversification.

Since the thin fuel tanks are smaller in the height dimension of the tank body 106 than regular fuel tanks, it is necessary to increase the tank width or the tank length to store as much fuel as regular fuel tanks. However, an increase in the tank width or the tank length of a fuel tank results in an increase in fuel level change due to inclination of the fuel tank. Therefore, in order to stably supply fuel to an engine, it is necessary to increase the volume of the chamber 102 to store sufficient fuel in the chamber 102.

In order to ensure a sufficient volume of the chamber 102, it is necessary to increase the outside diameter of the chamber 102 to make it almost agree with the inside diameter of the tank opening 104. This is because if the outside diameter of the chamber 102 is made greater than the diameter of the tank opening 104, the chamber 102 cannot be put into the tank body 106 through the tank opening 104.

The pump module 100 has an inner tubular portion 105*b* protruded downward from a plate 105*a* of the lid member 105 to seal the space between the tank opening 104 and the lid member 105 when the tank opening 104 is closed by the lid member 105.

In order to seal the tank opening 104 and the inner tubular portion 105*b*, it is necessary to make the outside diameter of the inner tubular portion 105 almost agree with the inside diameter of the tank opening 104. The inner tubular portion 105*b* is disposed opposite to an upper end portion 102*b* of the chamber 102.

Since a thin fuel tank is small in the height dimension of the tank body 106, when the height of the tank body 106 changes due to a change in internal pressure, thermal expansion or the like, the ratio of the change to the tank height is increased. Therefore, it is necessary for the pump module 100 fitted in a thin fuel tank to ensure a large amount of raise of the chamber 102.

However, since a thin fuel tank is lower in height than a regular fuel tank, the space between the upper end portion 102*b* of the chamber 102 and the inner tubular portion 105*b* of the lid member 105 is narrow. Therefore, when the height of the tank body 106 changes due to a change in internal pressure or thermal expansion, the chamber 102 being largely raised causes the upper end portion 102*b* of the chamber 102 to abut on the inner tubular portion 105*b*, preventing the raising of the chamber 102 midway. Therefore, the conventional pump module 100 cannot be applied to a thin fuel tank. Thus, there is demand for development of a pump module for fuel tanks applicable to thin fuel tanks.

SUMMARY OF THE INVENTION

According to the present invention, there is provided a pump module for use in a fuel tank, which comprises: a chamber designed to be disposed within a tank body of the fuel tank; a fuel pump disposed within the chamber; a lid member having an inner tubular portion at a bottom surface thereof, for closing a ceiling opening formed in the tank body with the chamber disposed within the tank body; a telescopic means for supporting the chamber telescopically movably relative to the lid member; and a spring member provided at the telescopic means, for pressing the chamber toward a bottom portion of the tank body, wherein at least an upper end portion of the chamber has an outside diameter smaller than an inside diameter of the inner tubular portion, so that the end portion can enter the inner tubular portion.

The outside diameter of the upper end portion of the chamber is thus made smaller than the inside diameter of the inner tubular portion so that the upper end portion can enter the inner tubular portion. Entry of the upper end portion of the chamber into the inner tubular portion can reduce the height of the pump module, and allows the pump module to be properly applied to a thin fuel tank of a low height as well as to a fuel tank of a normal height.

Preferably, the telescopic means comprises a sliding mechanism which includes at least one supporting rod for telescopically movably supporting the chamber, the supporting rod having an upper end portion retained in a retaining portion protruding upward from a top surface of the lid member. That is, the retaining portion for retaining the upper end portion of the supporting rod is protruded upward from the lid member. Consequently, the upper end portion of the chamber is not obstructed by the retaining portion when entering the inner tubular portion. Thus, the overall height of the pump module can be sufficiently reduced, and the pump module can be applied also to a thin fuel tank of a low height.

Desirably, the pump module further comprises a sealing portion for sealing a gap between the inner tubular portion formed to protrude downward from the bottom surface of the lid member and an inner surface of the ceiling opening.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
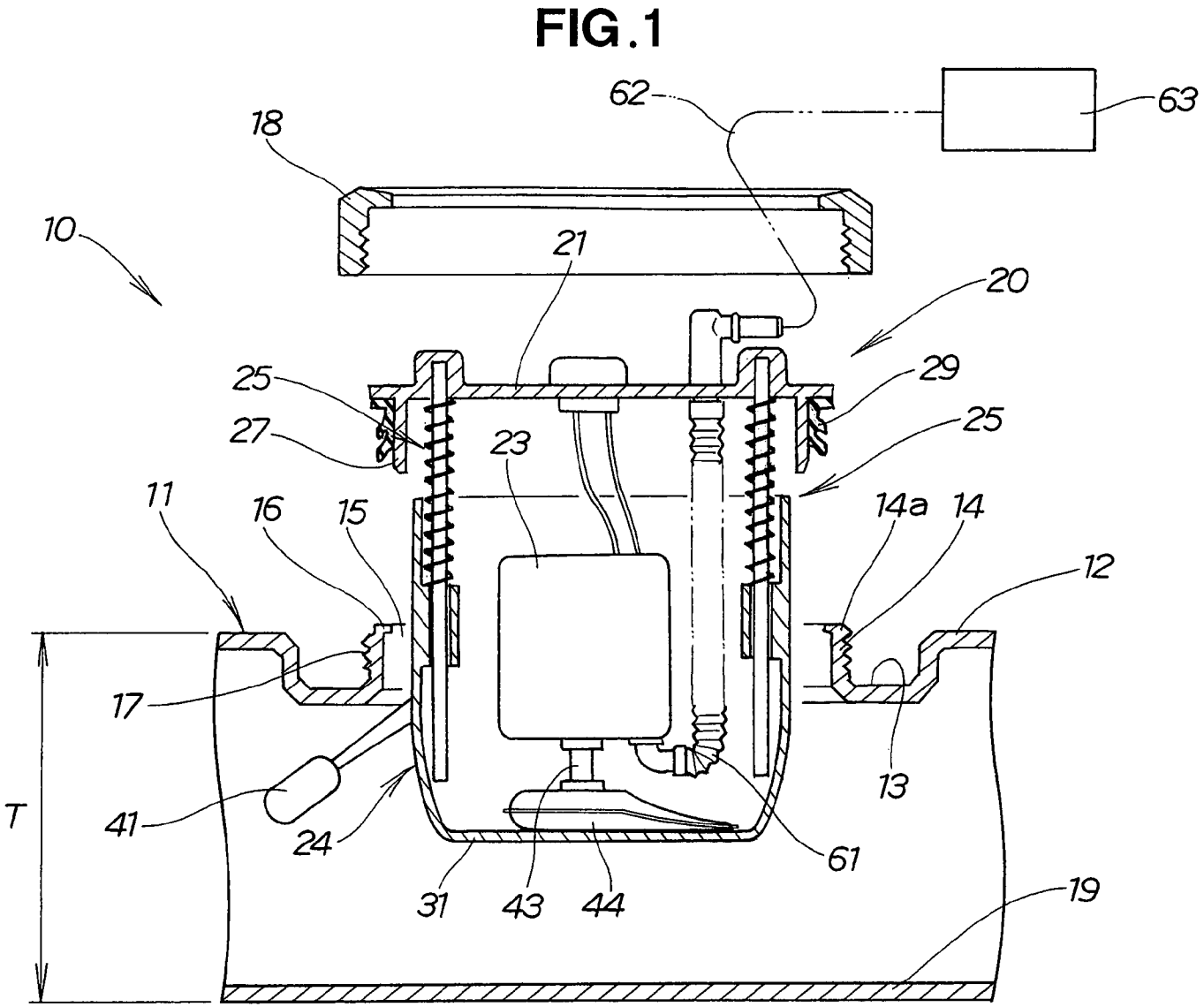
FIG. 1 is a cross-sectional view of a fuel tank provided with a pump module for a fuel tank according to the present invention.

A fuel tank 10 in the embodiment shown in FIG. 1 includes a tank body 11 and a pump module 20 held within the tank body 11.

The tank body 11 has an annular groove 13 formed in a ceiling portion 12. An opening (ceiling opening) 15 is formed in an upper end 14*a* of an inner wall 14 which forms a part of the groove 13. A flange 16 is extended from the upper end 14*a* of the inner wall 14 toward the opening 15. A thread 17 is formed around the outer peripheral surface of the inner wall 14. The pump module 20 is inserted through the opening 15 into the tank body 11, whereby the opening 15 is closed by a lid member 21 of the pump module 20. Then, a cap 18 is screw-connected to the thread 17 of the inner wall 14.

The tank body 11 is a resin tank, as an example, and the height T of the tank body 11 changes due to changes in internal pressure, thermal expansion, or the like of the tank body 11. When the height T of the tank body 11 changes, the ceiling portion 12 and a bottom portion 19 will change. However, for the sake of easy understanding, this embodiment will be described on the assumption that only the bottom portion 19 of the tank body 11 changes in vertical directions.

Figure 2:
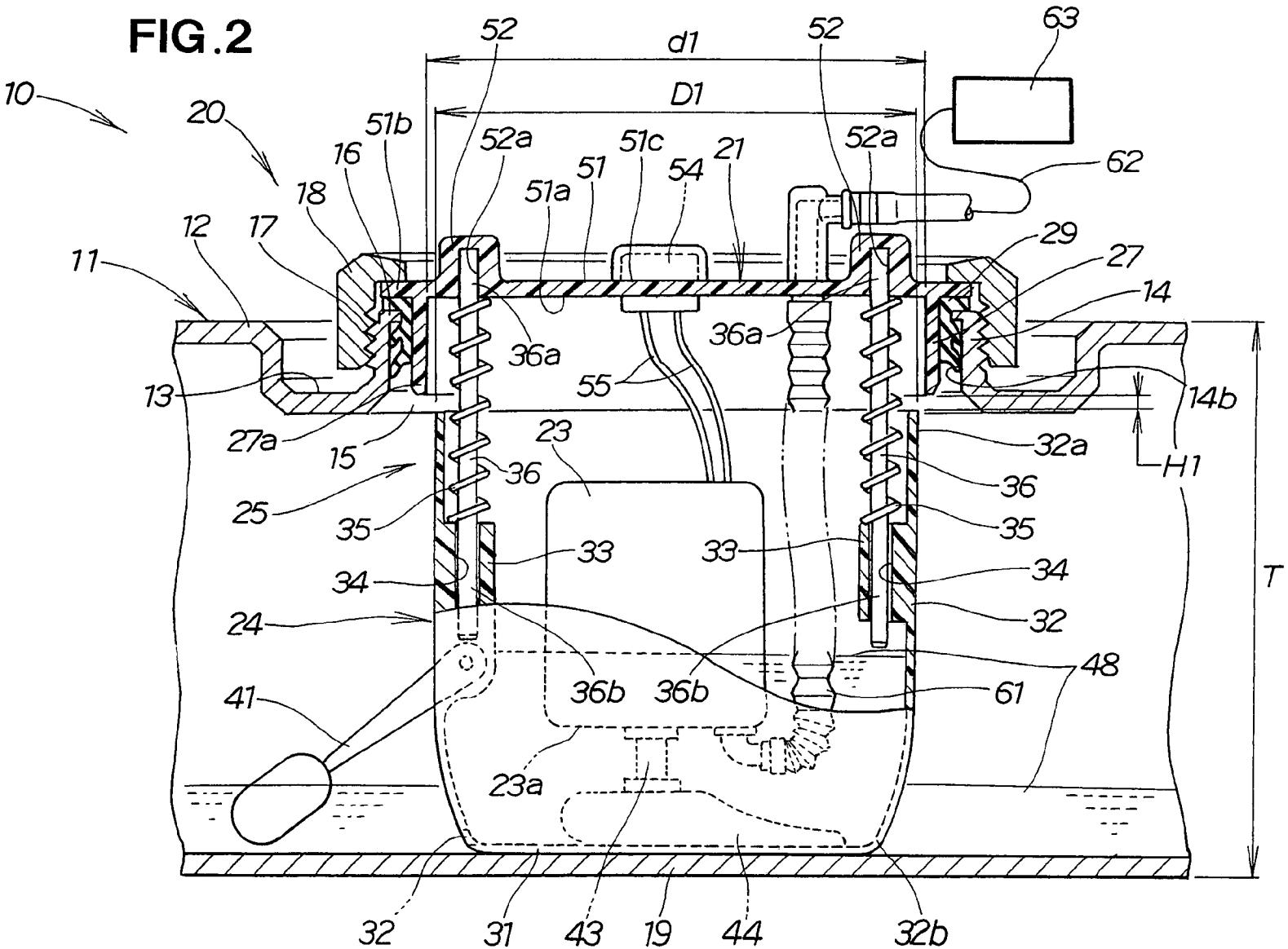
FIG. 2 is a cross-sectional view showing an example of application of the pump module shown in FIG. 1 to the fuel tank when the tank height is maximum.

FIG. 2 shows the fuel tank 10 when the height T of the tank body 11 is maximum.

The pump module 20 has a fuel pump 23 in a chamber 24. The chamber 24 is supported on the lid member 21 vertically movably via a sliding means 25. The ceiling opening 15 (see FIG. 1) of the tank body 11 is closed by the lid member 21 with the chamber 24 disposed within the tank body 11. A sealing member 29 seals the space between an inner tubular portion 27 of the lid member 21 and an inner surface (inner surface of the ceiling opening) 14*b* of the inner wall 14 of the tank body 11. The chamber 24 is pressed at a bottom portion 31 thereof onto the bottom portion 19 of the tank body 11 by a compression spring (spring member) 35 of the sliding means 25.

In the pump module 20, the outside diameter D1 of the chamber 24 is made smaller than the inside diameter d1 of the inner tubular portion 27 so that an upper end portion 32*a* of the chamber 24 can enter the inner tubular portion 27.

The chamber 24 is a resin container with a lower end portion 32*b* of a peripheral wall 32 closed by the bottom portion 31, and the upper end portion 32*a* open.

The chamber 24 includes raised portions 33, 33 on the inner surface of the peripheral wall 32. Guide holes 34, 34 are formed in the raised portions 33, 33, respectively, to extend vertically therethrough. A float gauge 41 for detecting the remaining amount of fuel is provided at the peripheral wall 32.

A suction pipe 43 extends downward from a bottom portion 23*a* of the fuel pump 23 provided within the chamber 24. A filter 44 is provided at the lower end of the suction pipe 43. The filter 44 is disposed at the bottom portion 31 of the chamber 24.

The chamber 24 has an inlet 32*c* provided at the lower end portion 32*b* of the peripheral wall 32, for introducing fuel 48 within the tank body 11 into the chamber 24. A check valve (not shown) is provided near the inlet 32*c*. The check valve prevents the fuel 48 within the chamber 24 from flowing back toward the tank body 11.

The lid member 21 is a resin member including a disk plate 51 for closing the opening 15 in the ceiling portion 12, the inner tubular portion 27 formed at a bottom surface 51*a* of the plate 51 to be protruded downward along an outer peripheral portion 51*b* of the plate 51, and a pair of retaining portions 52, 52 formed at a top surface 51*c* of the plate 51 to be protruded upward.

An electric connector 54 is provided on the top surface 51*c* of the plate 51. The electric connector 54 is connected to the fuel pump 23 with lead wires 55, 55, so that electric power is supplied to the fuel pump 23 through the electric connector 54 and the lead wires 55, 55.

The retaining portions 52, 52 have mounting holes 52*a*, 52*a* opening at the bottom surface 51*a* of the plate 51.

The outside diameter of the inner tubular portion 27 is smaller than the inside diameter of the flange 16 formed on the inner wall 14 of the ceiling portion 12. The inside diameter d1 of the inner tubular portion 27 is larger than the outside diameter D1 of the chamber 24.

The sealing member 29 is disposed between the inner tubular portion 27 and the inner surface 14*b* of the inner wall 14, and between the bottom surface of the outer peripheral portion 51*b* of the plate 51 and the top surface of the flange 16.

In this state, the cap 18 is screw-connected to the thread 17 of the inner wall 14, whereby the cap 18 presses the outer peripheral portion 51*b* of the plate 51 onto the sealing member 29. Consequently, the lid member 21 closes the opening 15 in the tank body 11, and the lid member 21 is fixed to the tank body 11.

The sliding means 25 includes metal supporting rods 36, 36 and compression springs 35, 35 mounted on the supporting rods 36, 36, respectively. The supporting rods 36, 36 have upper end portions 36*a*, 36*a* press-fitted into the mounting holes 52*a*, 52*a* in the lid member 21, thereby being fixed to the lid member 21. Lower end portions 36*b*, 36*b* of the supporting rods 36, 36 are slidably inserted into the guide holes 34, 34, respectively.

The guide holes 34 are through holes formed in the raised portions 33 on the peripheral wall 32 and extended vertically with upper and lower ends open to slidably support the supporting rods 36.

In the pump module 20 in this embodiment, when the tank height T of the tank body 11 is maximum, the chamber 24 is pressed downward by the spring forces of the compression springs 35, 35, and the bottom portion 31 of the chamber 24 abuts the bottom portion 19 of the tank body 11. In this state, the upper end portion 32*a* of the chamber 24 is located lower than a lower end portion 27*a* of the inner tubular portion 27 by H1.

With this pump module 20, the fuel pump 23 is driven so that the fuel 48 within the chamber 24 is drawn into the suction pipe 43 through the filter 44, and the indrawn fuel is supplied to an engine 63 through first and second supply pipes 61, 62.

Figure 3:
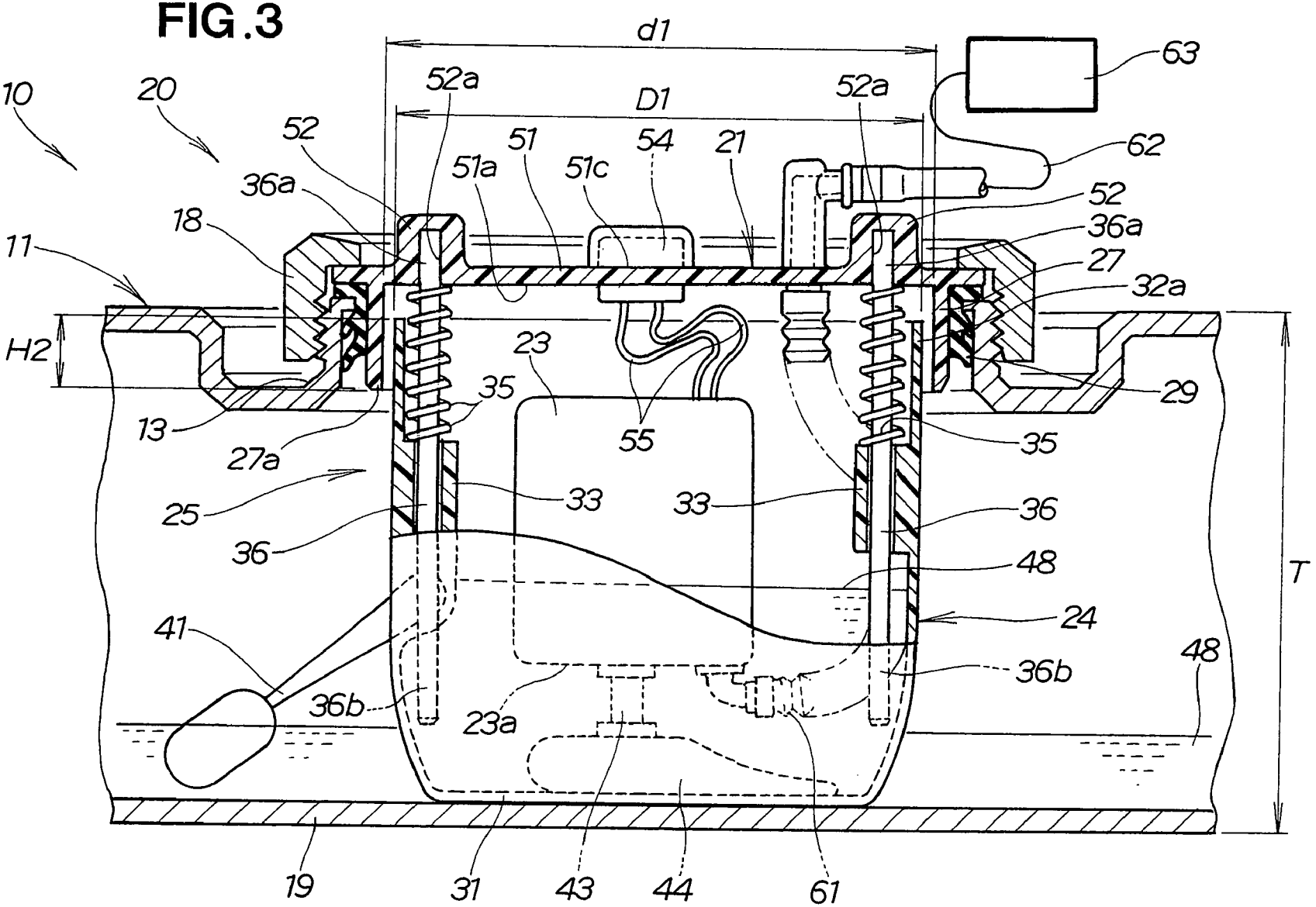
FIG. 3 is a cross-sectional view showing an example of application of the pump module shown in FIG. 1 to the fuel tank when the tank height is minimum.

FIG. 3 shows the fuel tank 10 with the pump module 20 when the tank height T is minimum.

The outside diameter D1 of the chamber 24 is made smaller than the inside diameter d1 of the inner tubular portion 27, so that the upper end portion 32*a* of the chamber 24 enters the inner tubular portion 27 when the tank height T of the tank body 11 is minimum.

In addition, since the retaining portions 52, 52 are protruded upward at the top surface 51*c* of the plate 51, the upper end portion 32*a* of the chamber 24 is prevented from abutting on the retaining portions 52, 52 when entering the inner tubular portion 27.

In this state, the upper end portion 32*a* of the chamber 24 is located higher than the lower end portion 27*a* of the inner tubular portion 27 by H2. Thus, when the tank height T of the tank body 11 is minimum, the overall height of the pump module 20 is reduced, so that the pump module 20 can be applied to the thin fuel tank 10.

Next, the function of the pump module 20 in this embodiment will be described with reference to FIG. 4B in comparison with a conventional comparative example shown in FIG. 4A.

Figure 4A:
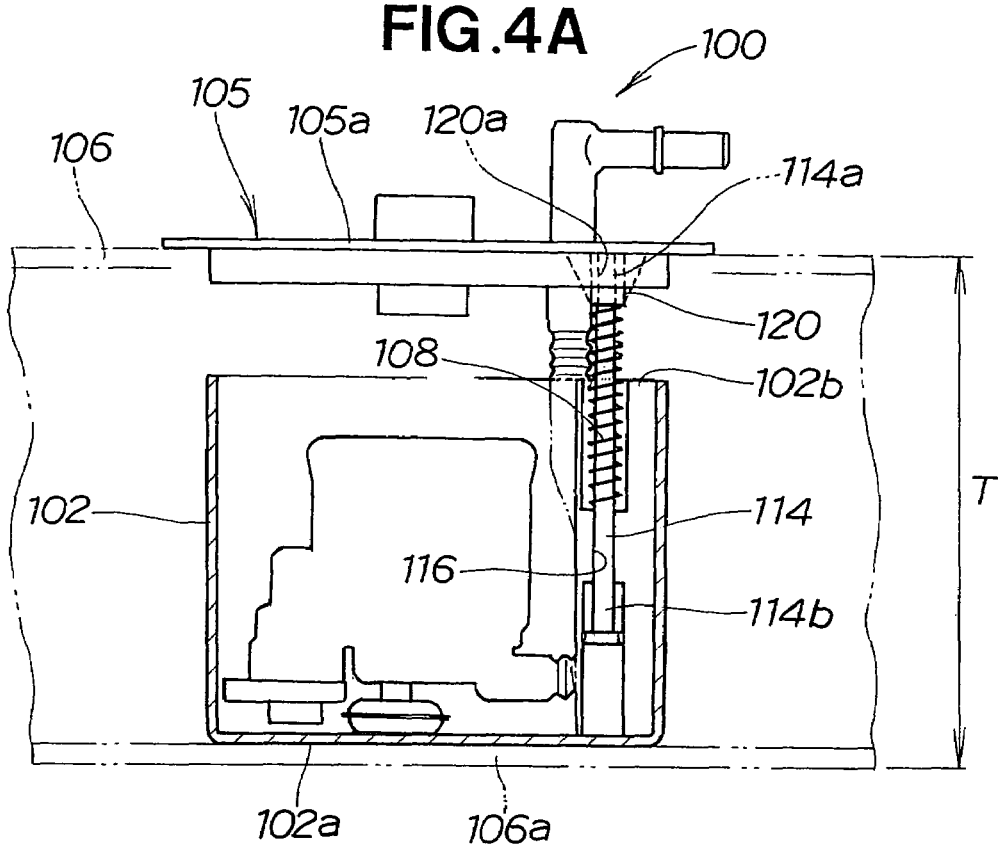
FIGS. 4A and 4B are schematic views showing in comparison the pump module for a fuel tank according to the present invention and a comparative example.

A pump module 100 in the comparative example shown in FIG. 4A is configured such that an upper end portion 114*a* of a supporting rod 114 is press-fitted into a mounting hole 120*a* of a retaining portion 120 provided at a lid member 105, thereby to fix the supporting rod 114 to the lid member 105; a compression spring 108 is mounted on the supporting rod 114; and a lower end portion 114*b* of the supporting rod 114 is slidably inserted into a guide hole 116 in a chamber 102.

With this pump module 100, the chamber 102 is pressed downward by the spring force of the compression spring 108, and a bottom portion 102*a* of the chamber 102 abuts a bottom portion 106*a* of a tank body 106.

The retaining portion 120 is protruded downward from the bottom surface of a plate 105*a* of the lid member 105. Therefore, in the tank body 106 of a low tank height T, the chamber 102 is pressed up by the bottom portion 106*a* of the tank body 106 against the compression spring 108, but an upper end portion 102*b* of the chamber 102 abuts on the retaining portion 120, preventing the pressing-up of the chamber 102 midway. Consequently, a sufficient amount of pressing-up of the chamber 102 cannot be ensured, and thus the pump module 100 cannot be applied to a thin fuel tank.

Figure 4B:
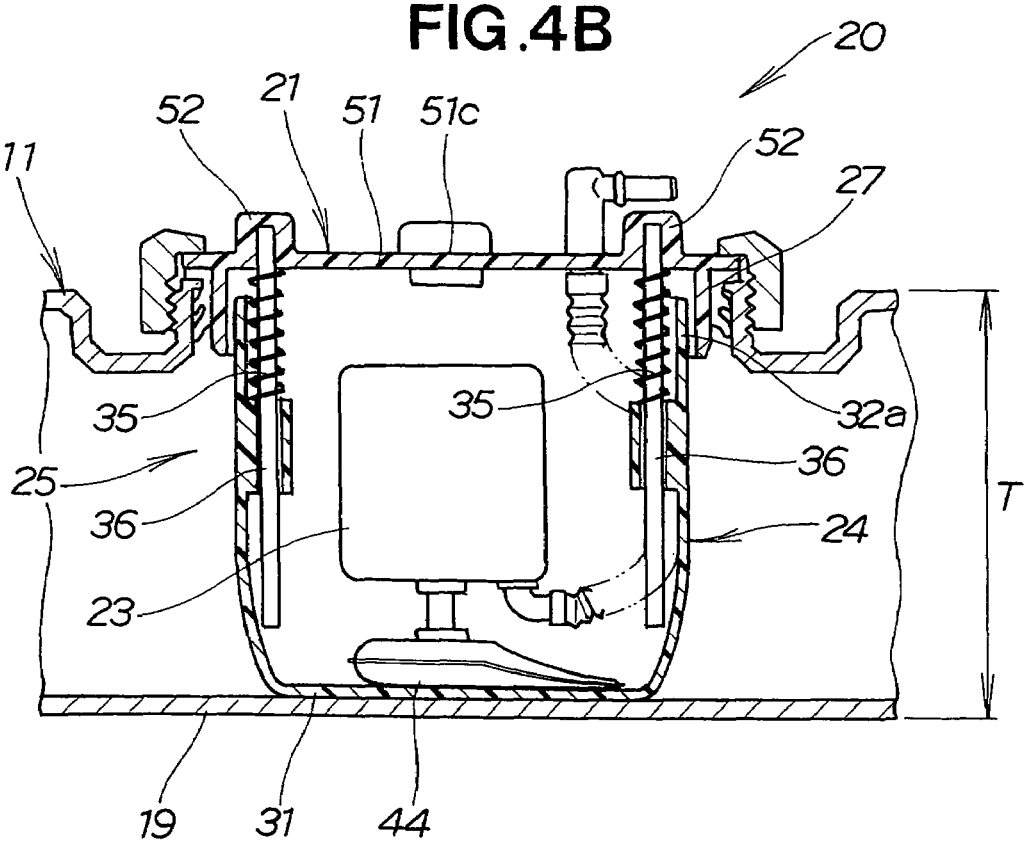
Figure 5:
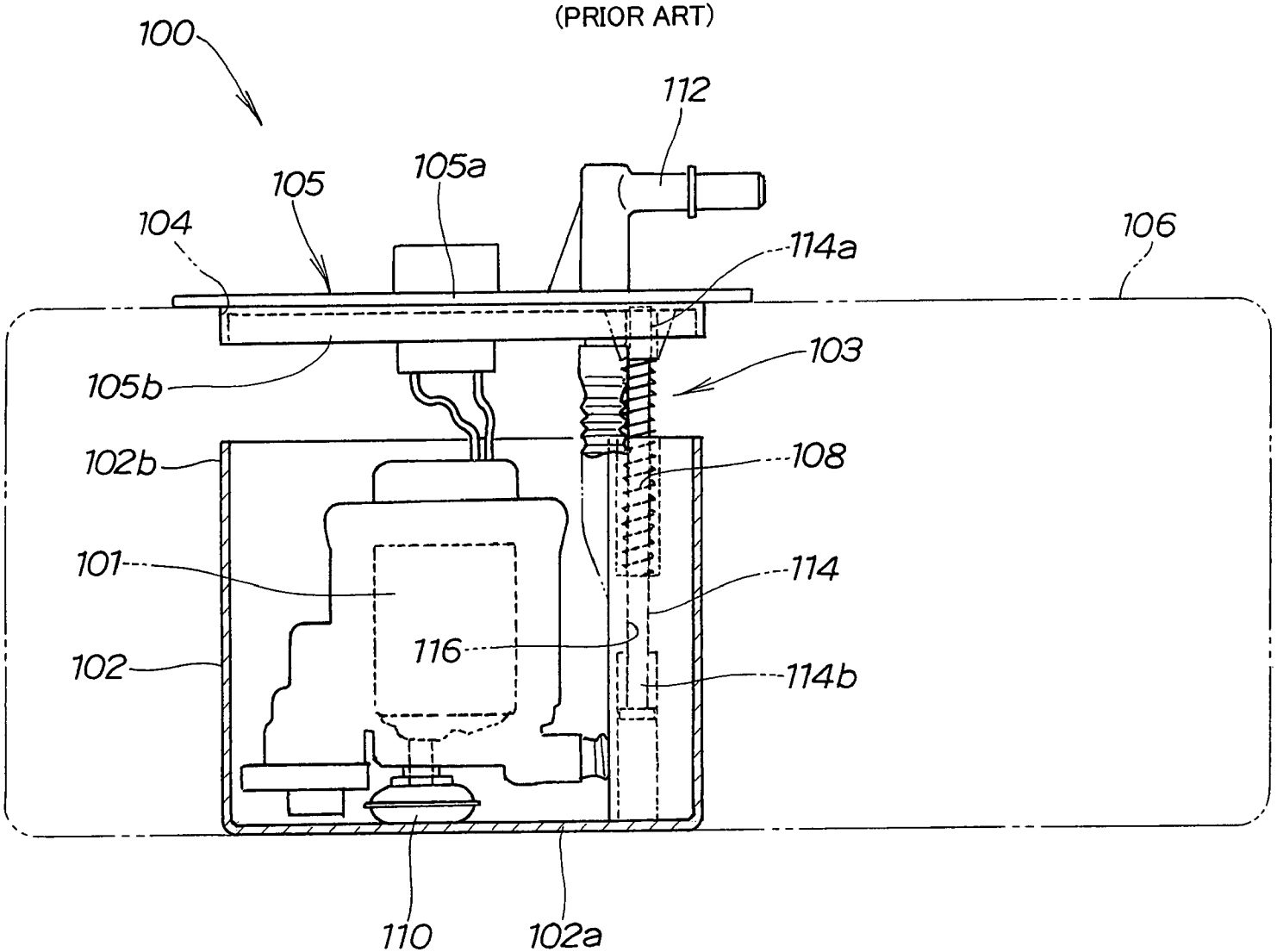
FIG.5 (PRIOR ART)
FIG. 5 is a schematic view of a fuel tank to which a conventional pump module is applied.

As shown in FIG. 4B, the retaining portions 52, 52 in this embodiment are provided at the top surface 51*c* of the plate 51 of the lid member 21 and protruded upward. Therefore, when the upper end portion 32*a* of the chamber 24 enters the inner tubular portion 27, the upper end portion 32*a* does not abut on the retaining portions 52, 52. Consequently, a sufficient entry of the upper end portion 32*a* of the chamber 24 into the inner tubular portion 27 is ensured, and thus the pump module 20 in this embodiment can be applied also to a thin fuel tank.

Although this embodiment has been described with the example where the outside diameter of the entire peripheral wall 32 constituting a part of the chamber 24 is D1, and the outside diameter D1 is made smaller than the inside diameter d1 of the inner tubular portion 27, the present invention is not limited thereto. It is also possible to form only the upper end portion 32*a* of the chamber 24, that is, a portion to enter the inner tubular portion 27 to have the outside diameter D1, and the other portion to have an outside diameter larger than D1. With this, a large space can be provided in the chamber 24, and it becomes possible to relatively easily determine the layout of members to be held in the chamber 24.

Further, this embodiment has been described with the example of providing the two supporting rods 36, but the number of the supporting rods 36 can be chosen as desired.

Furthermore, this embodiment has been described with the example of press-fitting the upper end portions 36*a*, 36*a* of the supporting rods 36, 36 into the mounting holes 52*a*, 52*a* of the retaining portions 52, 52, but the present invention is not limited thereto. For example, the upper end portions 36*a*, 36*a* of the supporting rods 36, 36 may alternatively be screw-connected to the retaining portions 52, 52.

In addition, this embodiment has been described with the supporting rods 36 as metal members, which is not limiting. For example, the supporting rods 36 may alternatively be made from resin.

Obviously, various minor changes and modifications of the present invention are possible in the light of the above teaching. It is therefore to be understood that within the scope of the appended claims the invention may be practiced otherwise than as specifically described.

What is claimed is:

1. A pump module for use in a fuel tank, comprising:

a chamber designed to be disposed within a tank body of the fuel tank;

a fuel pump disposed within the chamber;

a lid member having an inner tubular portion at a bottom surface thereof, for closing a ceiling opening formed in the tank body with the chamber disposed within the tank body;

a telescopic means for supporting the chamber telescopically movably relative to the lid member; and a spring member provided around the telescopic means, for pressing the chamber toward a bottom portion of the tank body;

wherein the chamber includes raised portions on an inner surface of a peripheral wall, and wherein the telescopic means are slidably insertable in guide holes in the raised portions, the guide holes having an inner diameter greater than an outer diameter of the telescoping means and less than an outer diameter of the spring member, and;

wherein at least an upper end portion of the chamber has an outside diameter smaller than an inside diameter of the inner tubular portion so that the upper end portion is engaged in the inner tubular portion.

2. A pump module as set forth in claim 1, wherein the telescopic means comprises a sliding mechanism which includes at least one supporting rod for supporting the chamber telescopically movably relative to the lid member, the supporting rod having an upper end portion retained in a retaining portion protruding upwardly from a top surface of the lid member.

3. A pump module as set forth in claim 1, further comprising a sealing portion for sealing a gap between the inner tubular portion protruding downwardly from the bottom surface of the lid member and an inner surface of the ceiling opening.

* * * * *